United States Patent [19]

Ota

[11] 4,069,936

[45] Jan. 24, 1978

[54] CAP FOR A BEVERAGE CONTAINER

[75] Inventor: Yoshihiro Ota, Tokyo, Japan

[73] Assignee: Shibazaki Seisakisho Ltd., Tokyo, Japan

[21] Appl. No.: 697,795

[22] Filed: June 21, 1976

[30] Foreign Application Priority Data

Sept. 1, 1975 Japan ..... 50-120583[U]

[51] Int. Cl.[2] ..... B65D 41/42

[52] U.S. Cl. ..... 215/256; 215/262

[58] Field of Search ..... 215/250, 253, 254, 255, 215/256, 262; 220/231, 271, 276

[56] References Cited

U.S. PATENT DOCUMENTS

| | | | |
|---|---|---|---|
| 1,052,382 | 2/1913 | Schmitt | 215/254 |
| 3,367,524 | 2/1968 | Lake | 215/256 |
| 3,416,687 | 12/1968 | Arnaud | 215/256 X |
| 3,446,383 | 5/1969 | Hannon | 215/253 X |
| 3,782,576 | 1/1974 | Jacquemijns | 215/253 |
| 3,812,993 | 5/1974 | Yoshioka | 215/256 |

*Primary Examiner*—Donald F. Norton

*Attorney, Agent, or Firm*—William Anthony Drucker

[57] ABSTRACT

A cap has a top wall and a skirt depending from the top wall. The skirt has two tabs depending therefrom. One tab may be employed to fracture the skirt along a circumferentially weakened first score of which the angle may be from 180° to 250° of the encircling expanse of the skirt. The other tab may be used to tear a portion of the skirt along a pair of radially weakened second scores and to bend the skirt at the inner end portions of those scores, and to introduce air into the container.

7 Claims, 3 Drawing Figures

CAP FOR A BEVERAGE CONTAINER

BACKGROUND OF THE INVENTION

The present invention relates to an improved cap for a beverage container with a relatively wide mouth.

Recently, glass or plastic bottles or containers which hold 100 to 250 ml of some beverage such as soft-drinks, milk, beer or sake have been accepted for beverage containers of convenient size for one or two persons. Thus, it is desired for a cap for the above-mentioned beverage containers to have a hermetically sealing ability for enabling the bottled beverage to be preserved without putrefaction or change in quality for a long period of time, and to have the function capable of easily removing the cap from the container by hand at any time and place without utilizing a corkscrew and without any danger.

Summary of the Invention

It is therefore the object of the invention to provide a novel cap for the abovementioned container. According to the present invention, there is provided a cap for securing on a container having an upper side wall communicating with an upper edge defining the container's mouth, said cap comprising:

a. a top wall for locating above an upper edge defining the container's mouth;

b. a skirt depending from the top wall so as to surround said upper side wall portion of the container;

c. a first score having a parallel section formed substantially parallel with the lower edge of the skirt over the angular range of about 180° to 250° and two oblique sections formed from both ends of the parallel section to the lower edge portions of the skirt so as to incline at an obtuse angle;

d. a first bendable tab provided at the lower edge of the skirt in such a manner that its upper edge extends from one oblique section of the first score;

e. a spaced pair of second scores extending from the bottom edge of the skirt to the top edge of the skirt, said second scores extending from the top edge of the skirt toward the center of the cap and terminating in inner end portions for positioning slightly inside said upper edge of the container, a portion of the top wall between said inner end portions providing a bending line spaced radially inwardly from said upper edge; and f. a second bendable tab provided at that lower edge portion of the skirt which is positioned at substantially the middle between the second scores, said cap being removable from the container, upon the skirt portion of the cap beneath the first score being first torn away by means of the first bendable tab, and then the cap portion defined by the second scores being torn by means of the second bendable tab to introduce air into the container thereby to enable easy removal of the cap.

Upon removing the cap from the container, if the skirt portion surrounded by the first score is first cut off by means of the first tab and then the cap portion defined by the second scores is cut up by means of the second tab, then the cap of the aforesaid construction has the advantage of being removed as easily as possible from the container by hand without any danger, even if a flange portion is provided around the container's mouth so that the lower edge portion of the skirt is bended inwardly of the container to contact with the bottom of the flange portion, and pressure in the container has a negative value.

BRIEF DESCRIPTION OF THE DRAWINGS

A preferred embodiment of the invention will now be described with reference to the accompanying drawing, wherein.

Figure 1:
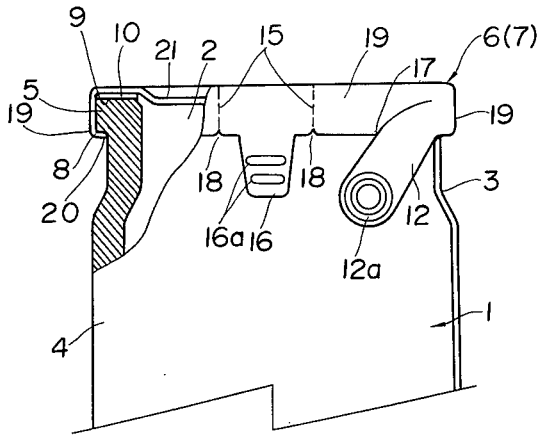
FIG. 1 is a front view, partly in section, of a cap of the invention sealing a beverage container's mouth.
Figure 2:
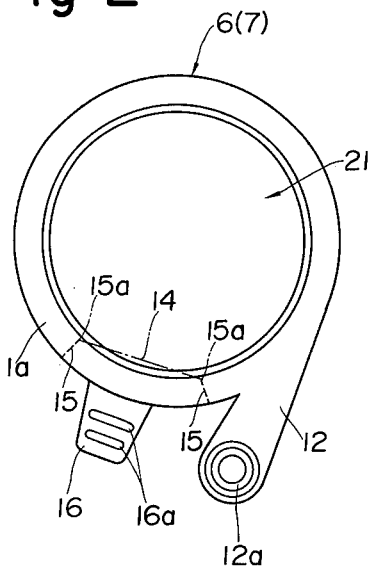
FIG. 2 is a plan view of the cap shown in FIG. 1 which shows a bending line at the inner end portions of second scores.
Figure 3:
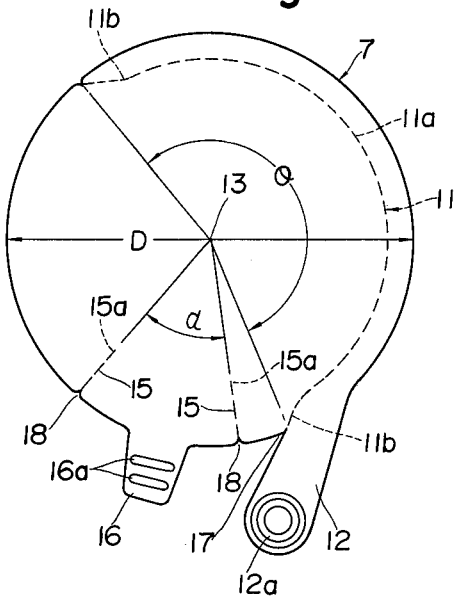
FIG. 3 is a developed view of the cap shown in FIGS. 1 and 2 which illustrates the arrangement of first and second scores.

A cap according to the invention has its construction particularly suitable for beverage containers with a relatively wide mouth, as apparent from FIGS. 1 to 3.

In FIG. 1, reference numeral 1 denotes a cylindrical glass (or plastic) bottle or container manufactured to hold therein about 100 to 250 ml, e.g., 200 ml of beverage such as soft-drinks, milk, beer or sake, and to have an open mouth 2 at its upper surface to be hermetically sealed. The container 1 is about 100 mm in its total height. An upper wall section defining the mouth 2 and a neck section 3 communicating therewith with the added height of about 15 mm are each formed to have an inner diameter of about 45 mm, while the remaining lower side wall section 4 of the container 1 with the height of about 85 mm is formed to have an inner diameter of about 47 mm. On the other hand, the neck section 3 and the lower side wall section 4 communicating therewith is formed to have the wall of about 3 mm thickness, while only the upper wall section defining the mouth 2 is formed to have the wall thickness of about 5 mm, i.e., the outer diameter of about 55 mm so as to have a ring-shaped flange 5 of about 3 mm height projecting outwardly of the neck section 3 by about 2 mm for attaching the hereinunder described cap 6 according to the invention.

Thus, the cap 6 for hermetically sealing the mouth 2 of the beverage container 1 is manufactured as hereinunder described in accordance with the invention.

A relatively thin, workable metal plate 7 (FIG. 3) such as aluminum or tin integrally provided with the later described tabs 12 and 16 and having a dimension required hemetically to seal the container's mouth 2, e.g., in this example, having the diameter of about 70 mm and the thickness of about 0.15–0.3 mm (preferably 0.23 mm) is first prepared. Thus, an appropriate paint 8 having an anticorrosive effect is painted on the whole inner surface of the metal plate 7 with the thickness of about 15 $\mu$, and a sealing material 10 such as soft, flexible, vinyl chloride group resin compound is coated on the inner wall portion (in this example, ring portion having the inner diameter of about 46 mm and the outer diameter of about 57 mm) of the metal plate 7 which is located on the upper edge 9 defining the mouth 2 with the thickness of about 1–1.5 mm in the conventional manner.

Then, a predetermined inner wall portion (in this example, portion of the metal plate 7 with the diameter of about 62 mm spaced from the outer wall surface thereof by about 4 mm) of that section (the section forms, as evident from FIG. 1, the skirt 19 of the cap 6) of the metal plate 7 which is to be bent along the upper outer wall portion defining the container's mouth 2 is notched with a first score 11 which comprises a narrow groove of substantially V-shaped cross section with about two thirds the depth of the thickness of the metal plate 7, and which has a parallel section 11*a* formed substantially parallel with the outer wall surface of the metal plate 7 over the angular range of about 180° to 250° (in this example, 200° ) and two oblique sections 116 formed from both ends of the parallel section 11*a* to the outer edge portions of the metal plate 7 so as to incline at an appropriate obtuse angle (in this example, about 140°). The aforesaid bendable tab 12 is so formed that its inner wall surface is aligned with an imaginary extention line of one oblique section 116 of the first score 11 with the width of about 10 mm and the central-length of about 20 mm.

On the other hand, a pair of second scores 15 similar to the first score 11 are formed in the appropriate inner wall portions of the metal plate 7 where the first score 11 is not provided from two spaced outer edge portions of the metal plate 7 mutually making an angle $\alpha$ of about 50° toward the geometric center 13 thereof to inner end portions 15*a*, 15*a* of the top wall sections 21 of the metal plate 7. When the container's mouth 2 is practically sealed by the cap 6 as shown in FIGS. 1 and 2, and then first and second scores are cut, a bending line 14 is formed between the inner end portions 15*a*, 15*a* of the top wall sections 21. Said inner end portions 15*a*, 15*a* are situated in such a position that the bending line 14 traverses the inner wall portion of the upper edge 9 of the container 1. In other words, the inner end portions 15*a*, 15*a* are each positioned slightly inside the inner wall portion of the upper wall 9 of the container 1. The second scores 15 each comprise a narrow groove of substantially V-shaped cross section having about two thirds the depth of the thickness of the metal plate 7.

The aforesaid bendable tab 16 is previously provided at that edge portion of the metal plate 7 which is situated at substantially the middle between the second scored lines 15, and has the width of about 8 mm and the length of about 12 mm.

Further, it is desired that those edge portions of the metal plate 7 which corresponds to one end of the first score 11 at which the tab 12 is provided and to each outer end of the second scores 15 are respectively formed with substantially V-shaped slits 17 and 18 (FIG. 3) for facilitating the later described operation upon removing the cap 6 from the container 1.

Also, uneven surface portions 12*a* and 16*a* are formed on the tabs 12 and 16 respectively.

Thus, after a predetermined amount of any desired beverage is poured in the container 1, the metal plate 7 with the sealing material 10 accurately put onto the upper wall 9 defining the mouth 2 of the container 1 is pressed at an appropriate pressure by a capping machine (not shown) as is well known to those skilled in the art, thereby to enable the material 10 to be snugly sealed on the upper edge of the container's mouth 2. Then, the capping machine squeezes the outer annular portion of the metal plate 7 along the side wall of the flange 5 of the container 1 and the bottom thereof to form a skirt 19 and a lip 20, respectively. At the same time, the aforesaid tabs 12 and 16 are pushed down so as to contact with the side wall of the container 1, and that top inner annular portion 21 of the metal plate 7 which is defined by the upper inner wall of the container's mouth 2 is pressed down by about 1 mm, as shown in FIG. 1, thereby enabling the container's mouth 2 hermetically to be sealed by the pressed and squeezed metal plate 7 or the cap 6. Accordingly it will be apparent that beverage contained in the container 1 can be easily preserved without putrefaction and change in quality for a long period of time.

When, on the other hand, it is desired to remove the cap 6 from the container 1, then the skirt portion 19 and the lip portion 20 of the cap 6 which are surrounded by the first score 11 are cut away by the first bendable tab 12, and then that portion of the cap 6 which is defined by the second scores 15 is cut up by the second bendable tab 16, introducing air into the container 1.

Therefore, the cap 6 constructed in accordance with the invention has the advantage of being removed as easily as possible from the container 1 by hand, even if pressure in the container 1 has so a negative value as in the case where beverage held therein is heated or cooled for the purpose of pasteurization that the cap 6 is strongly pressed by atmosphere pressure onto the container's mouth 2.

It should be noted that, if the first score 11 is formed over a considerably smaller angular range than 180° or the second scores 15 are formed to make a considerably wider angle than 50° toward the geometric center of the cap 6, then a stronger force is required to remove the cap 6 from the container 1, often undesirably hurting one's hand or pouring out beverage in the container 1 therefrom.

It should be also noted that, each inner end 15*a* of the second scores 15 can be extended more inwardly than desired from the viewpoint of introducing air into the container 1 upon cutting up the cap portion defined by the second scores 15, but it is not desired from the viewpoint of hermetically sealing the container's mouth 2 for a long period of time.

While there has been described one embodiment of the invention, obviously changes and variations are possible without departing from the appended claims. For example, it has been proved by the present inventor that the above-mentioned construction of a cap manufactured in accordance with the invention is hardly affected by the shape or the dimension of the container's mouth to be sealed.

What is claimed is:

1. A cap, for securing on a container having an upper side wall portion communicating with an upper edge defining the container's mouth, said cap comprising:

a. a top wall for locating above said upper edge defining the container's mouth;

b. a skirt depending from the top wall so as to surround said upper side wall portion of the container;

c. a first score having a parallel section formed substantially parallel with the lower edge of the skirt over the angular range of about 180° to 250° and two oblique sections formed from both ends of the parallel section to the lower edge portions of the skirt so as to incline at an obtuse angle;

d. a first bendable tab provided at the lower edge of the skirt in such a manner that its upper edge extends from one oblique section of the first score;

e. a spaced pair of second scores extending from the bottom edge of the skirt to the top edge of the skirt, said second scores extending from the top edge of the skirt toward the center of the cap and terminating in inner end portions for positioning slightly inside said upper edge of the container, a portion of the top wall between said inner end portions providing a bending line spaced radially inwardly from said upper edge; and f. a second bendable tap provided at that lower edge portion of the skirt which is positioned at substantially the middle between the second scores, said cap being removable from the container, upon the skirt portion of the cap beneath the first score being first torn away by means of the first bendable tab, and then the cap portion defined by the second scores being torn by means of the second bendable tab to introduce air into the container thereby to enable easy removal of the cap.

2. A cap, according to claim 1, wherein the first score comprises a narrow groove formed over the angular range of about 200° and extending about two thirds the depth of the cap thickness, and wherein the second scores comprise two narrow grooves of about two thirds the depth of the cap thickness, said second scores defining an angle of about 50° to the geometric center of the cap.

3. A cap, according to claim 1, wherein one end of the first score closest to the first bendable tab and each lower end of the second scores are each formed with a substantially V-shaped slit.

4. A cap, according to claim 1, wherein the first and second bendable tabs are each formed with an uneven surface portion.

5. In combination, a cap according to claim 1, and a container having an upper wall defining a mouth having a flange portion communicating with the upper wall, said cap being secured on said container and sealing said mouth, that lower edge portion of the skirt being further inwardly bent to form a lip contacted with the bottom of the flange portion.

6. In combination, a cap as claimed in claim 1, and a container having an upper side wall portion communicating with an upper edge defining the container's mouth, the cap being secured on the container and sealing said mouth, the container being made selectively of glass or plastic with a relatively wide mouth, the cap being made of a workable metal, selectively aluminum or tin, about 0.15 to 0.3 mm thick.

7. The combination claimed in claim 20, wherein at least the inner wall of the cap is coated with paint, and wherein that inner wall portion of the cap which is placed on the upper edge of the container's mouth is lined with a soft, flexible sealing material.

* * * * *